US006560851B1

(12) United States Patent
Yamamoto et al.

(10) Patent No.: US 6,560,851 B1
(45) Date of Patent: May 13, 2003

(54) METHOD FOR PRODUCING AN INDUCTOR

(75) Inventors: Takahiro Yamamoto, Yokaichi (JP); Tadashi Morimoto, Hikone (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/610,151

(22) Filed: Jul. 5, 2000

Related U.S. Application Data

(62) Division of application No. 09/139,745, filed on Aug. 25, 1998, now Pat. No. 6,104,272.

(30) Foreign Application Priority Data

Aug. 25, 1997 (JP) ..... 9-244679
Aug. 27, 1997 (JP) ..... 9-247624

(51) Int. Cl.[7] ..... H01F 7/06

(52) U.S. Cl. ..... 29/602.1; 29/605; 29/608; 29/840; 336/192; 336/206; 336/212

(58) Field of Search ..... 29/602.1, 605, 29/608, 840; 336/192, 206, 212

(56) References Cited

U.S. PATENT DOCUMENTS

| | | | | |
|---|---|---|---|---|
| 4,597,169 A | | 7/1986 | Chamberlin | 29/605 |
| 4,696,100 A | * | 9/1987 | Yamamoto et al. | 29/605 |
| 5,274,913 A | * | 1/1994 | Grebe | 29/840 |
| 5,359,311 A | | 10/1994 | Kawabata et al. | 336/83 |
| 5,428,337 A | | 6/1995 | Vinclarelli et al. | 336/223 |
| 5,576,680 A | | 11/1996 | Ling | 336/200 |
| 5,821,843 A | | 10/1998 | Mamada et al. | 336/83 |
| 5,949,465 A | * | 9/1999 | Taniguchi | 347/205 |

* cited by examiner

*Primary Examiner*—Peter Vo
*Assistant Examiner*—Paul Kim
(74) *Attorney, Agent, or Firm*—Burns, Doane, Swecker & Mathis, LLP

(57) ABSTRACT

A method for producing an inductor having an internal conductor includes coating an internal conductor with a covering material, placing the internal conductor coated with the covering material in a shaping mold, and filling a material around the internal conductor so as to form a compact unbaked chip element with the internal conductor provided at a predetermined position. The unbaked chip element is then baked in order to eliminate the covering material so as to form a gap around the internal conductor.

9 Claims, 3 Drawing Sheets

METHOD FOR PRODUCING AN INDUCTOR

This application is a divisional, of application Ser. No. 09/139,745 filed Aug. 25, 1998 now U.S. Pat. No. 6,104, 272.

This application corresponds to Japanese Patent Application Nos. 9-244679, filed Aug. 25, 1997, and 9-247624, filed on Aug. 27, 1997, and both of which are hereby incorporated by reference in their entireties.

BACKGROUND OF THE INVENTION

1. Field of the Invention

The present invention relates generally to inductors and, more particularly, to a system and method for producing an inductor with improved characteristics.

2. Description of the Related Art

FIGS. 7A and 7B illustrate a conventional layered-type inductor. This type of inductor is an example of a surface mounting type inductor. As illustrated in FIGS. 7A and 7B, the layered-type inductor is provided with a layered-type coil 52 formed by interconnecting a plurality of internal conductors 52*a*. The layered-type inductor also includes external electrodes 53*a*, 53*b* which are connected to respective end portions of the coil 52.

As illustrated in FIGS. 7A and 7B, such a layered-type inductor is commonly produced by laminating a plurality of ceramic green sheets 54 applied with internal conductors 52*a* having a predetermined pattern and formed via a printing method, connecting the internal conductors 52*a* via a hole 55 so as to form a coil, baking the coil, applying a conductor paste to a predetermined position of the element 51 and baking so as to form external electrodes 53*a*, 53*b*.

Since the internal conductor comprising the coil is provided via a printing method, it is difficult to have a thick internal conductor 52*a* (in general, 20 $\mu$m is said to be the upper limit). As a result, the electric resistance of the internal conductor (coil) cannot be lower than a certain level.

In order to solve this problem, an inductor, as illustrated in FIG. 8, has been introduced. This inductor comprises an internal conductor 62 prepared by forming a coil with a metal wire (such as an Ag wire) surrounded by an element 61 made from a ceramic material. The inductor also comprises external electrodes 63*a*, 63*b* provided in the element 61. However, since the ceramic element 61 and the internal conductor 62 are closely contacted, stress is generated therebetween due to the contraction difference between the ceramic 61 and the internal conductor 62 at the time of baking. This stress generates cracks in the ceramic. One skilled in the art will appreciate that stress can remain in the inductor even when cracks are not generated. Furthermore, stress can also be generated due to the contraction difference between the ceramic and the internal conductor as a result of a temperature change due to the surrounding environment or the usage condition.

The stress that remains in the inductor and the stress generated by the usage condition, as mentioned above, not only deteriorate the electric characteristics of the inductor, but may also generate cracks in the ceramic, depending upon the size of the stress. Moreover, repetition of application and release of stress also serves as the cause of crack generation in the ceramic. Crack generation leads to an increase in the leakage flux which further deteriorates the characteristics of the inductor.

SUMMARY OF THE INVENTION

The present invention seeks to overcome these deficiencies in the art by providing a inductor which reduces the risk of generating stress between a material of an element such as a ceramic, and the internal conductor and generating cracks inside the inductor chip.

An inductor according to the present invention comprises a chip element accommodating a conductor (internal conductor) and external electrodes. The internal conductor comprises a metal wire formed in a nonlinear shape. In an exemplary embodiment of the present invention, the internal conductor has a coil-like shape with portions adjacent to each other with respect to the axial direction of the coil being positioned in a substantially cylindrical gap formed in the axial direction of the coil.

Since a metal wire is used for the internal conductor, the resistance of the internal conductor can be lowered. Furthermore, since a gap is provided around the internal conductor, the stress generation between the ceramic and the internal conductor, as set forth above in association with the conventional inductor (without a gap), can be prevented. Therefore, desired characteristics can be realized with improved reliability without the risk of generating cracks inside the chip.

As indicated above, the internal conductor is formed in a nonlinear shape. "Nonlinear" refers to various kinds of curved or wound shapes. Representative examples thereof include, but are not limited to, a zigzag (meandering) shape and a coil (spiral) shape.

The present invention is further characterized in that the chip element is formed with a magnetic ceramic or a dielectric ceramic material. Since a magnetic ceramic or a dielectric ceramic material is used as a component for the chip element, an inductor having desired characteristics can be obtained securely to realize the effects of the present invention.

The present invention is further characterized in that the internal conductor is provided by forming a wire made from a material selected from the group consisting of Ag, Cu, Ni and an alloy thereof. Since the internal conductor is provided by forming a wire made from a material selected from the group consisting of Ag, Cu, Ni and an alloy thereof, an internal conductor having a small electric resistance and a desired nonlinear shape can be formed securely to realize the effects of the present invention.

The present invention is further characterized in that the internal conductor has a coil-like shape, and portions in the metal wire comprising the internal conductor adjacent to each other with respect to the axial direction are arranged in a substantially cylindrical gap formed in the axial direction of the coil in the chip element. Since the internal conductor has a coil-like shape, a sufficient inductance can be obtained. And further, since portions of the metal wire which are adjacent to each other with respect to the axial direction are arranged in a substantially cylindrical gap formed so as to communicate in the axial direction of the coil, characteristic deterioration or crack generation in the chip caused by stress generated between the ceramic and the internal conductor can be prevented securely.

Further, since portions adjacent to each other with respect to the axial direction (i.e., coil pitch portions) in the coil-like internal conductor are integrated and accommodated in the substantially cylindrical gap, the leakage flux among the coil pitches can be reduced to improve the characteristics.

A method of producing an inductor according to the present invention comprises the steps of coating the internal conductor, comprising a nonlinear metal wire, with a covering material to be eliminated at the time of baking, placing the internal conductor coated with the covering material in a shaping mold, filling an element material around the internal conductor so as to form a compact (unbaked chip element) with the internal conductor provided at a predetermined position, and baking the unbaked chip element thereby eliminating the covering material and forming a gap around the internal conductor.

By coating the internal conductor with a covering material, and placing the same in a shaping mold, filling an element material around the internal conductor so as to form a compact (unbaked chip element) with the internal conductor provided at a predetermined position, and eliminating the covering material by baking the unbaked chip element, a gap can be formed around the internal conductor securely so that an inductor according to the present invention can be produced efficiently.

An alternative method of producing an inductor according to the present invention comprises the steps of coating the internal conductor comprising a coil-like metal wire with a covering material to be eliminated at the time of baking with portions of the metal wire adjacent to each other with respect to the axial direction of the coil integrated, placing the coil-like internal conductor coated with the covering material in a shaping mold, filling an element material around the internal conductor so as to form a compact (unbaked chip element) with the internal conductor provided at a predetermined position, and baking the unbaked chip element to eliminate the covering material so as to form a substantially cylindrical gap around the coil-like internal conductor for integrally accommodating the portions in the metal wire.

By coating the internal conductor comprising a coil-like metal wire with a covering material with portions in the metal wire adjacent to each other with respect to the axial direction of the coil integrated, placing the same in a shaping mold and filling an element material around the internal conductor so as to form a compact (unbaked chip element) with the internal conductor provided at a predetermined position and eliminating the covering material by baking the unbaked chip element, a substantially cylindrical gap for integrally accommodating the portions in the metal wire, a gap can be formed around the coil-like internal conductor securely so that an inductor according to the present invention can be produced efficiently.

The present invention is further characterized in that the covering material is selected from the group consisting of a resin material to be eliminated by decomposition or combustion at the time of baking, and a low melting point metal material to be eliminated by melting at the time of baking. By using a resin material to be eliminated by decomposition or combustion at the time of baking (such as an enamel resin), or a low melting point metal material to be eliminated by melting at the time of baking (such as solder, tin, and bismuth) as the covering material, the covering material can be eliminated securely at the time of baking so that a desired gap can be formed around the internal conductor.

BRIEF DESCRIPTION OF THE DRAWINGS

The foregoing and other objects, features and advantages of the present invention will be more readily understood upon reading the following detailed description in conjunction with the drawings in which.

DESCRIPTION OF PREFERRED EMBODIMENT

In the following, the exemplary embodiments of the present invention are explained with reference to the drawings.

Figure 1:
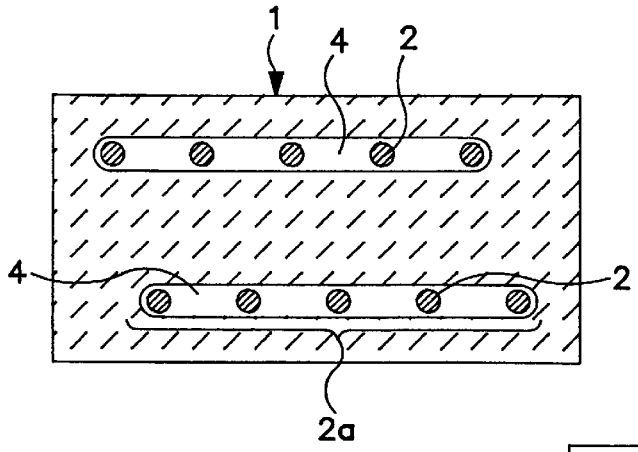
FIG. 1 is a planar cross-sectional view of a chip element comprising an inductor of the present invention.
Figure 2:
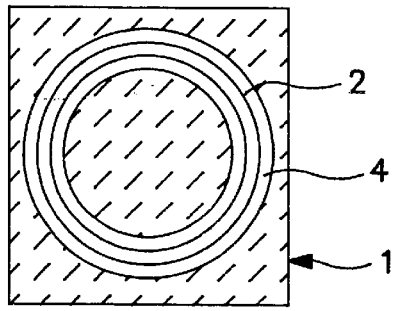
FIG. 2 is a lateral cross-sectional view of a chip element comprising an inductor of the present invention.
Figure 3:
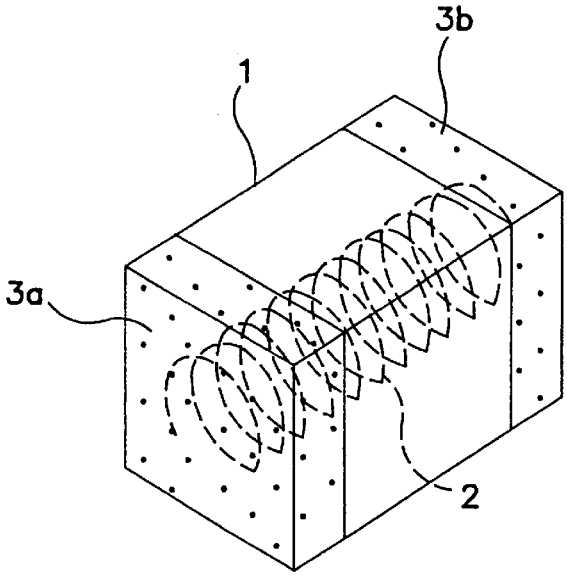
FIG. 3 is a perspective view showing an inductor of the present invention.

FIG. 1 is a plan cross-sectional view of an element (i.e., chip element) comprising an inductor according to an exemplary embodiment of the present invention. FIG. 2 is a lateral cross-sectional view thereof. FIG. 3 is a perspective view of the inductor of the present invention.

As shown in FIG. 3, the inductor is provided with an internal conductor 2. The internal conductor 2, according to an exemplary embodiment of the present invention, is a metal wire formed in a coil-like shape. The internal conductor is formed within an element (chip element) 1 made from a ceramic material and having external electrodes 3*a*, 3*b* conductive with the internal conductor 2 at both ends of the element 1.

As is evident from the lateral view of FIG. 2, a substantially cylindrical (circular cylindrical) gap 4 is formed so as to surround the coil-like internal conductor (coil) 2. The internal conductor (coil) 2 is accommodated in the gap 4 such that portions adjacent to each other with respect to the axial direction (coil pitch portions) 2*a* are integrated and arranged in the gap 4. In FIG. 3, the gap 4 is not shown.

Preferred ceramic materials for forming the element 1 include magnetic ceramics such as Ni—Cu—Zn ferrite and dielectric ceramics such as barium titanate. One skilled in the art will appreciate, however, that these materials are merely exemplary and that other ceramic materials could also be used, such as $MgO—Al2O_3—SiO_2$ type $MgO—SiO_2$ type, $Al2O_3—SiO_2$ type, and $MgO—Al2O_3$ type.

The metal wire of the internal conductor 2 is preferably made from a material selected from, but not limited to, the group consisting of Ag, Cu, Ni and an alloy, having a low resistance value. Further, it is preferable to use a wire having a 50 to 400 $\mu$m diameter according to the characteristics of the inductor.

Figure 4:
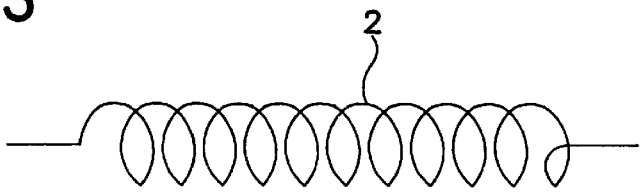
FIG. 4 is a diagram showing the forming of a coil (internal conductor) according to the present invention.
Figure 5A:
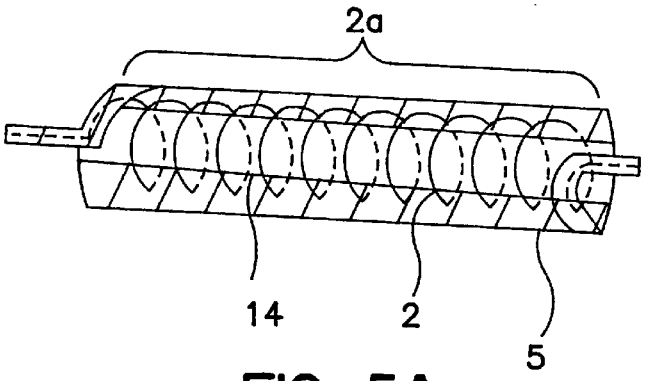
FIG. 5A is a diagram showing the coating of a coil with a covering material according to the present invention.
Figure 5B:
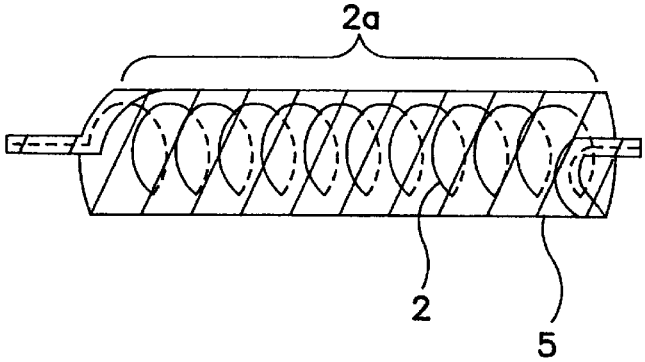
FIG. 5B is a diagram showing another coating of a coil with a covering material according to the present invention.

A method for producing the inductor of the present invention will be explained with reference to FIGS. 4–6. As illustrated in FIG. 4, a coil 2 is formed by shaping a metal wire (for example, an Ag wire) in a well known manner. The coil 2 is coated with a resin covering material which, according to an embodiment of the present invention is an enamel resin 5, as shown in FIG. 5A. The coil 2 is coated with the covering material 5 such that portions of the coil which are adjacent to each other with respect to the axial direction (coil pitch portions) 2*a* are integrated and a through hole 14 is formed inside the coil. As described later, a ceramic material is filled in the through hole 14. Depending upon the shape of the coil, through hole 14 can be omitted. In other words, the coil can be embedded in the covering material and the inside of the coil can be filled with the covering material as shown in FIG. 5B. Moreover, it is also possible to form the wire material in a coil-like shape after coating the wire material with the covering material. In this case, there may be spacings between portions of the coil adjacent to each other with respect to the axial direction. Alternatively, portions of the coil adjacent to each other with respect to the axial direction are embedded in the covering material.

In order to prevent cracking at the time of baking, it is useful to consider the thickness of the covering material 5 (coat thickness) in coating the metal wire in view of the contraction ratio of the ceramic material. For example, if the ceramic has a 20% contraction ratio at the time of baking and a coat thickness of approximately 20% with respect to the diameter of the metal wire is used, crack generation at the time of baking can be efficiently prevented.

Figure 6:
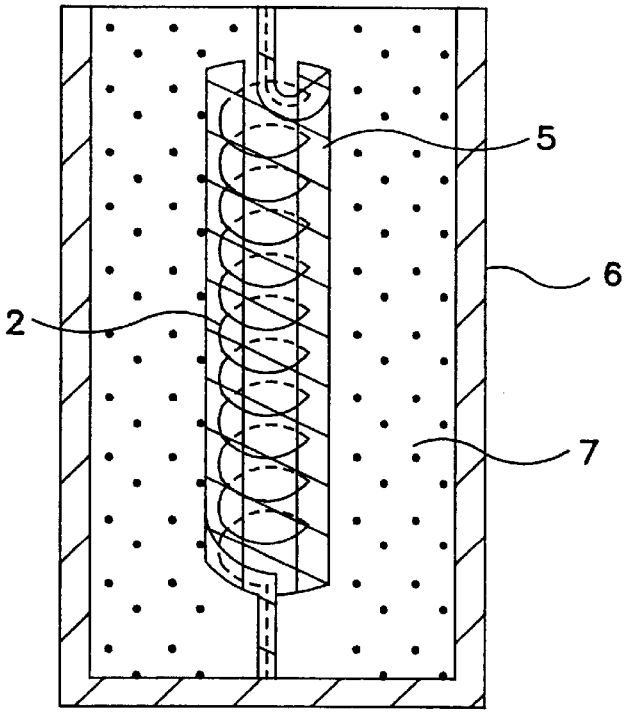
FIG. 6 is a diagram showing the forming of a ceramic in and around the internal conductor according to the present invention.
Figure 7A:
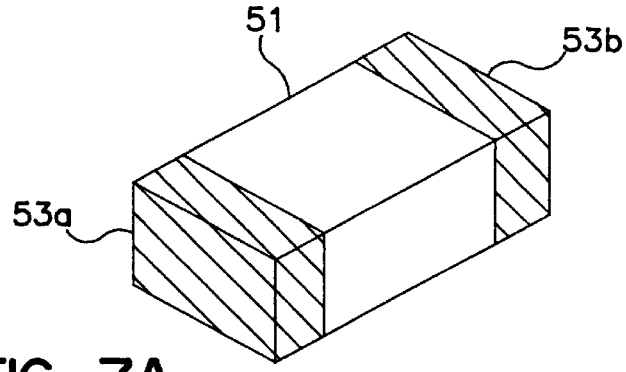
FIG. 7A PRIOR ART
FIG. 7A is a perspective view of a conventional layered-type inductor.
Figure 7B:
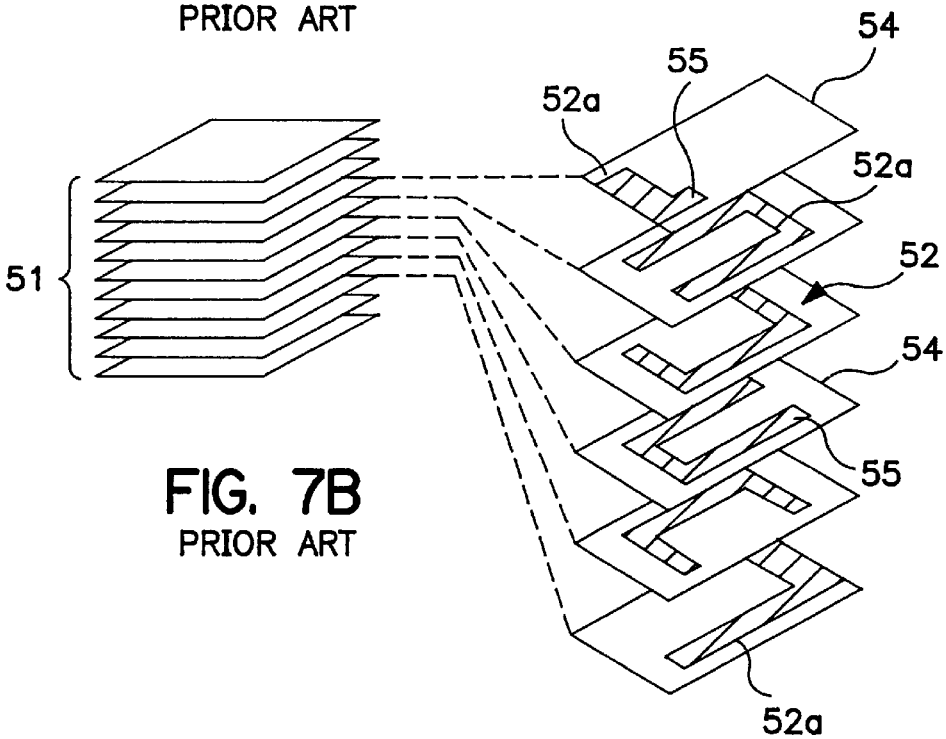
FIG. 7B PRIOR ART
FIG. 7B is an exploded perspective view of the main parts of a conventional layered-type inductor before lamination.
Figure 8:
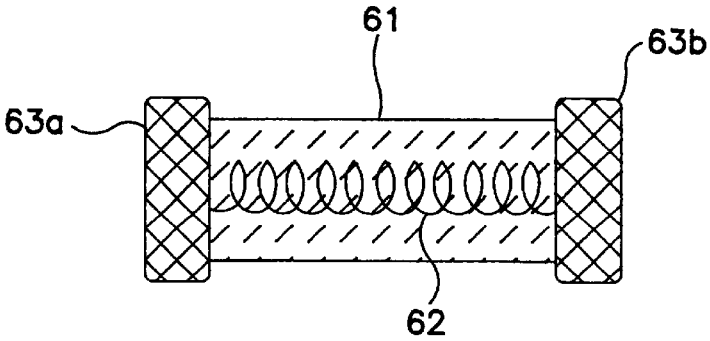
FIG. 8 PRIOR ART
FIG. 8 is a cross-sectional view of a conventional inductor.

As shown in FIG. 6, the coil 2 coated with the covering material 5 is placed in a shaping mold 6, with a ceramic material 7 poured in the shaping mold 6. The ceramic material 7 is filled in the through hole 14 and around the coil 2. In an exemplary embodiment, a gel casting method is used for forming the ceramic whereby a slurry, prepared by mixing ceramic material powders, an epoxy resin and a hardening agent, is poured into a mold having the internal conductor (coil) placed therein. Other examples of methods for forming the ceramic include a resin hardening method where a mixture prepared by mixing ceramic material powders and a thermosetting resin is filled in a mold having the internal conductor (coil) placed therein for heating and hardening and a casting forming method where a slurry is poured into a gypsum mold having the formed internal conductor (coil) placed therein followed by dehydration.

By applying a heat treatment to the obtained compact (unbaked chip element), the covering material 5 coated on the coil 2 is eliminated by decomposition or combustion and the ceramic is sintered so as to obtain the chip element 1 shown in FIGS. 1 and 2.

A substantially cylindrical gap 4 is formed in the chip element and surrounds the internal conductor (coil) 2. The coil 2 is maintained in the gap 4 such that portions adjacent to each other with respect to the axial direction (coil pitch portions) 2*a* are integrated and accommodated.

By applying a conductive paste to a predetermined position of the chip element 1 (in this embodiment, the positions include both end faces where both end portions of the coil 2 are exposed) and baking, external electrodes 3*a*, 3*b* (FIG. 3) are formed. Accordingly, the inductor shown in FIG. 3 can be obtained.

As mentioned above, since the inductor according to this embodiment is provided with a gap 4 around the coil 2 comprising the internal conductor, and the coil 2 is maintained in the gap 4 such that portions adjacent to each other with respect to the axial direction (coil pitch portions) 2*a* are integrated and accommodated in the gap 4, characteristic deterioration of the inductor and crack generation in the chip caused by stress generated between the ceramic and the internal conductor due to, for example, temperature change in a thermal processing or during use can be prevented securely. Moreover, since portions adjacent to each other with respect to the axial direction (coil pitch portions) 2*a* in the coil 2 are integrated and accommodated in the substantially cylindrical gap, the leakage flux among the coil pitches can be reduced to improve the characteristics.

Table 1 provides a comparison of a conventional inductor (i.e., one that does not have a gap around the internal conductor) and the inductor of the present invention.

TABLE 1

| | Conventional Inductor | Inductor of the Present Invention |
|---|---|---|
| Resistance value of the internal conductor | 2 Ω | 10 mΩ |
| Impedance (100 MHz) | 800 Ω | 1.5 kΩ |

As shown in Table 1, the resistance value of the inductor of the present is less than 1/10 that of the conventional inductor. Moreover, the impedance of the inductor of the present invention is about twice as much as that of the conventional conductor.

Although the internal conductor of the present invention has been set forth above as comprising a coil, one skilled in the art will appreciate that the present invention can be applied equally well to internal conductors having various nonlinear shapes other than a coil.

Additionally, although the covering material has been set forth above as being a resin material, and more specifically, an enamel resin material, one skilled in the art will appreciate that various other kinds of resin materials, which can be eliminated by decomposition or combustion at the time of baking, may be used without departing from the spirit and scope of the invention. Moreover, the covering material is not limited to a resin material, but various low melting point metal materials such as solder, tin, and bismuth can be used as well.

The present invention is not limited to the above-mentioned embodiment also in other aspects, and thus various applications and modifications can be adopted in terms of the element shape, the shape and the position of the external electrode, the coating method for the covering material, and the like, within the range of the invention.

What is claimed is:

1. A method for producing an inductor having an internal conductor, said method comprising the steps of:

coating the internal conductor with a covering material;

placing the coated internal conductor in a shaping mold;

filling an element material around the coated internal conductor so as to form a compact unbaked chip element with the coated internal conductor provided at a predetermined position; and baking the unbaked chip element in order to eliminate the covering material so as to form a gap between the internal conductor and the element material.

2. The method according to claim 1, wherein the covering material is selected from a group consisting of a resin material which is eliminated by decomposition or combustion during said baking step, and of a low melting point metal material which is eliminated by melting during said baking step.

3. The method according to claim 2, wherein the element material is a ceramic material.

4. A method for producing an inductor having an internal conductor comprising a coil-shaped metal wire, said method comprising the steps of:

covering portions of the coil-shaped metal wire which are adjacent to each other with respect to an axial direction of the coil-shaped metal wire with a covering material;

placing the coil-shaped metal wire coated with the covering material in a shaping mold;

filling an element material around the coated coil-shaped metal wire so as to form a compact unbaked chip element with the coated coil-shaped metal wire provided at a predetermined position; and baking the unbaked chip element in order to eliminate the covering material so as to form a substantially cylindrical gap between the coil-shaped metal wire and the element material for accommodating the portions adjacent to each other with respect to the axial direction of the coil-shaped metal wire.

5. The method according to claim 4, herein the covering material is selected from a group consisting of a resin material which is eliminated by decomposition or combustion during said baking step, and of a low melting point metal material which is eliminated by melting during said baking step.

6. The method according to claim 4, wherein the element material is a ceramic material.

7. A method for reducing stress between an internal conductor and a chip element of an inductor, said method comprising the steps of:

coating the internal conductor with a covering material;

placing an element material around the coated internal conductor to form an unbaked chip element; and baking the unbaked chip element in order to eliminate the covering material so as to form a gap between the internal conductor and the element material, wherein stress is reduced as a result of the gap between the internal conductor and the element material.

8. The method according to claim 7, wherein the covering material is selected from a group consisting of a resin material which is eliminated by decomposition or combustion during said baking step, and of a low melting point metal material which is eliminated by melting during said baking step.

9. A method for producing an inductor having an internal conductor comprising a coil-shaped metal wire, said method comprising the steps of:

covering portions of the coil-shaped metal wire which are adjacent to each other with respect to an axial direction of the coil-shaped metal wire integrally with a covering material;

placing the coated internal conductor in a shaping mold;

filling an element material around the coated coil-shaped metal wire and in a through hole formed with respect to the axial direction of the coated coiled-shaped metal wire so as to form a compact unbaked chip element with coil-shaped metal wire provided at a predetermined position; and baking the unbaked chip element in order to eliminate the covering material so as to form a substantially cylindrical gap between the coil-shaped metal wire and the element material integrally accommodating the portions adjacent to each other with respect to the axial direction of the coil shaped metal wire.

* * * * *